US007623818B2

(12) United States Patent
Ohhara et al.

(10) Patent No.: US 7,623,818 B2
(45) Date of Patent: Nov. 24, 2009

(54) BELT FIXING DEVICE AND IMAGE FORMING APPARATUS THEREWITH

(75) Inventors: Hideaki Ohhara, Kanagawa (JP); Yasutaka Naito, Kanagawa (JP); Kazuyoshi Itoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 425 days.

(21) Appl. No.: 11/543,201

(22) Filed: Oct. 5, 2006

(65) Prior Publication Data

US 2007/0242990 A1 Oct. 18, 2007

(30) Foreign Application Priority Data

Apr. 18, 2006 (JP) ..... P2006-114478

(51) Int. Cl.
*G03G 15/20* (2006.01)

(52) U.S. Cl. ..... 399/329

(58) Field of Classification Search ..... 399/24, 399/67, 328, 329
See application file for complete search history.

(56) References Cited

U.S. PATENT DOCUMENTS 5,146,163 A * 9/1992 Nawa ..... 324/232
6,597,888 B1 * 7/2003 Abe et al. ..... 399/329

FOREIGN PATENT DOCUMENTS

JP HEI.5-9027 B 2/1993

* cited by examiner

*Primary Examiner*—Sandra L Brase
(74) *Attorney, Agent, or Firm*—Morgan, Lewis & Bockius LLP

(57) ABSTRACT

A belt fixing device includes an endless belt member, an excitation coil and a deterioration detection unit. The endless belt member includes a metal layer. The excitation coil heats the metal layer by electromagnetic induction. The deterioration detection unit detects deterioration of the metal layer of the belt member through the excitation coil.

7 Claims, 6 Drawing Sheets

BELT FIXING DEVICE AND IMAGE FORMING APPARATUS THEREWITH

BACKGROUND

1. Technical Field

This invention relates to a fixing device for heating, pressurizing, and fixing an unfixed toner image, used with an electrophotographic-type image forming apparatus such as a copier, a printer or a facsimile and in particular to a belt fixing device of an electromagnetic (magnetic) induction heating system and an image forming apparatus using the belt fixing device.

2. Description of the Related Art

Hitherto, in an electrophotographic-type image forming apparatus such as a copier or a printer, for example, a photosensitive member formed like a drum (photosensitive drum) is uniformly charged and is exposed to light, which is controlled based on image information, so as to form an electrostatic latent image on the photosensitive drum. After the electrostatic latent image is formed into a visible image (toner image) with toner and the toner image is transferred from the photosensitive drum directly to a recording medium or after the toner image is once primarily transferred to an intermediate transfer body and is secondarily transferred from the intermediate transfer body to a recording medium, a fixing device fixes the toner image onto the recording medium.

A fixing device of a heating roller system is widely used as a fixing device used in such an image forming apparatus.

In addition to such a heating roll system, a fixing device of an electromagnetic induction heating system has also been known.

In the fixing device of an electromagnetic induction heating system, a roller or a thin fixing belt with a metal layer is used as a fixing member to be heated. When the thin fixing belt is used as the fixing member, the fixing belt can be warmed up in an extremely short time.

The main factor of determining the life of the fixing device of the electromagnetic induction heating system using the fixing belt as described above is a metal layer of a heat generation layer. Generally, since the heat generation layer subjected to electromagnetic induction heating is made of metal, the metal is fatigue-broken because of repeated deformation in the nip portion. As a result, the metal layer does not serve the function as the heat generation layer. This point in time leads to the end of the life of the fixing device of the electromagnetic induction heating system using the fixing belt.

An effective life detection method has not yet been developed for the fixing device of the electromagnetic induction heating system.

SUMMARY

According to an aspect of the invention, a belt fixing device includes an endless belt member, an excitation belt and a deterioration detection unit. The endless belt member includes a metal layer. The excitation coil heats the metal layer by electromagnetic induction. The deterioration detection unit detects deterioration of the metal layer of the belt member through the excitation coil.

BRIEF DESCRIPTION OF THE DRAWINGS

Exemplary embodiments of the invention will be described in detail below with reference to accompanying drawings wherein.

DETAILED DESCRIPTION

Referring to the accompanying drawings, exemplary embodiments of the invention will be described below.

To begin with, the schematic configuration of an image forming apparatus to which a belt fixing device according to this exemplary embodiment of the invention is applicable will be described with reference to FIG. 1.

Figure 1:
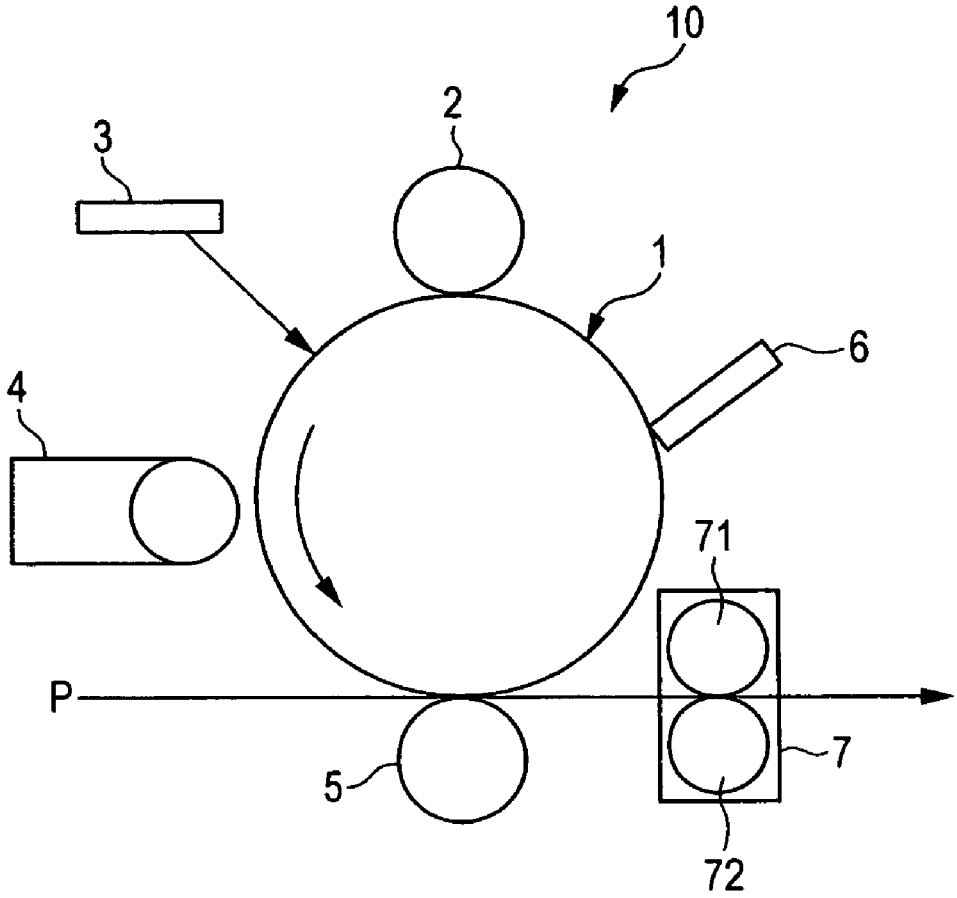
FIG. 1 is a schematic drawing to schematically show the configuration of an image forming apparatus according to an exemplary embodiment of the invention.

As schematically shown in FIG. 1, an image forming apparatus 10 to which this exemplary embodiment is applicable includes a photosensitive drum 1 on which a latent image based on the electrostatic potential difference is formed on its surface by applying light image to the photosensitive drum 1 after uniformly charging the photosensitive drum 1. A charging device 2, an exposure device 3, a developing device 5, a transfer roll 4 and a cleaning device 6 are disposed on the surroundings of the photosensitive drum 1. The charging device 2 uniformly charges the surface of the photosensitive drum 1. The exposure device 3 applies the image light to the photosensitive drum 1 to form the latent image on the surface of the photosensitive drum 1. The developing device 4 selectively transfers toner to the latent image formed on the photosensitive drum 1 to form a toner image on the photosensitive drum. The transfer roller 5 faces the photosensitive drum 1 and generates a transfer bias electric field between the transfer roller 5 and the photosensitive drum 1 while clamping a recording material P therebetween. The cleaning device 6 removes the remaining toner on the photosensitive drum 1 after the toner image is transferred. The recording material P is fed from the upstream of the facing part between the photosensitive drum 1 and the transfer roller 5 in the transport direction. A fixing device 7 for heating, pressurizing and fixing the unfixed toner image transferred onto the recording material P is disposed on the downstream side of the facing part between the photosensitive drum 1 and the transfer roller 5 in the transport direction. Examples of the photosensitive drum 1 may include a photosensitive drum provided by forming on a surface of a metal drum a photosensitive member layer made of organic photosensitive material, amorphous selenium based photosensitive material or amorphous silicon based photosensitive material. The charging device 2 may be provided by coating a roller of metal having electric conductivity such as stainless steel or aluminum with a high-resistance material. The charging device 2 is brought into contact with the photosensitive drum 1 to follow the rotation of the photosensitive drum 1. A predetermined voltage is applied to the charging device 2. Thereby, the charging device 2 produces continuous discharge in a minute gap in the proximity of the contact portion between the charging roll 2 and the photosensitive drum 1 for almost uniformly charging the surface of the photosensitive drum 1. The exposure device 3 generates a laser beam blinking based on an image signal. The exposure device 3 scans the laser beam in the main scanning direction of the photosensitive drum 1 by a polygon mirror, to thereby form an electrostatic latent image on the surface of the photosensitive drum 1. The developing device 4 stores black toner, for example. The developing device 4 faces the photosensitive drum 1 while the developing device 4 and the photosensitive drum 1 are close to each other. The developing device 4 transfers the toner in response to the latent image on the photosensitive drum 1 to form a visible image. The transfer roll 5 may be made of a conductive or semiconductive roll-like member. A transfer bias voltage is applied to the nip portion between the transfer roller 5 and the photosensitive drum 1, to thereby transfer the toner image carried on the photosensitive drum 1 to the recording material P. The cleaning device 6 has a blade (not shown), for example, and presses the blade against the surface of the photosensitive drum 1 to scrape and remove the remaining toner on the photosensitive drum 1. In place of the blade, the remaining toner may be scraped by a roll-like member or may be swept out by a brush.

The fixing device 7 according to this exemplary embodiment of the invention is implemented as a belt fixing device of an electromagnetic induction heating system including a fixing belt 71 and a pressurization roll 72. The fixing belt 71 is subjected to electromagnetic induction heating and is rotatable. The pressurization roll 72 is in pressure-contact with the fixing belt 71 while being parallel to the axis of the fixing belt 71.

The image forming apparatus to which the invention is applicable is not limited to the exemplary embodiment described above. For example, the invention may also be applied to an image forming apparatus of the rotary type in which an image forming unit are placed on a rotation body. Alternatively, the invention may be applied to an image forming apparatus of the tandem type in which image forming units are placed side by side.

Figure 2:
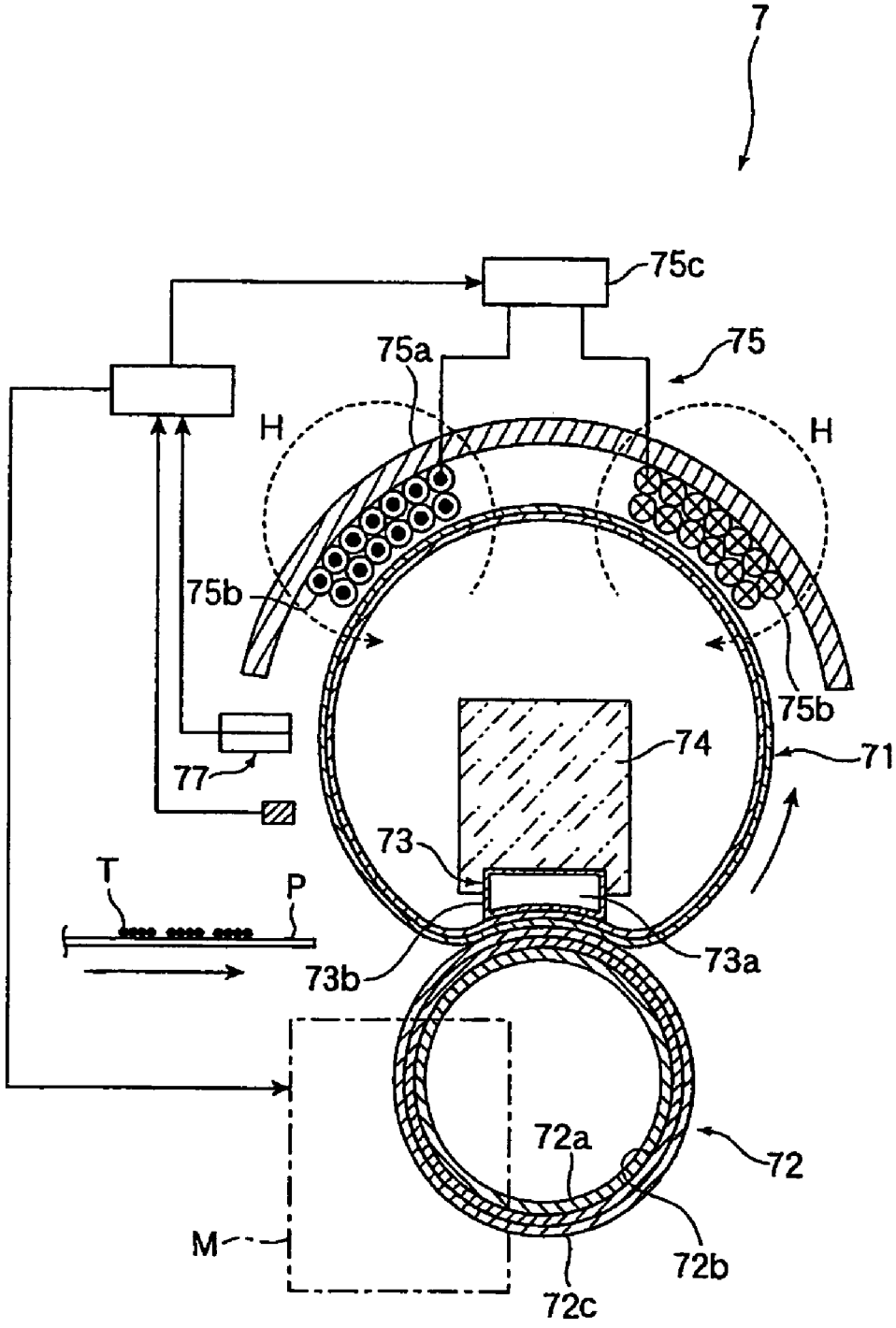
FIG. 2 is a schematic sectional view of a fixing device according to the exemplary embodiment of the invention.
Figure 3:
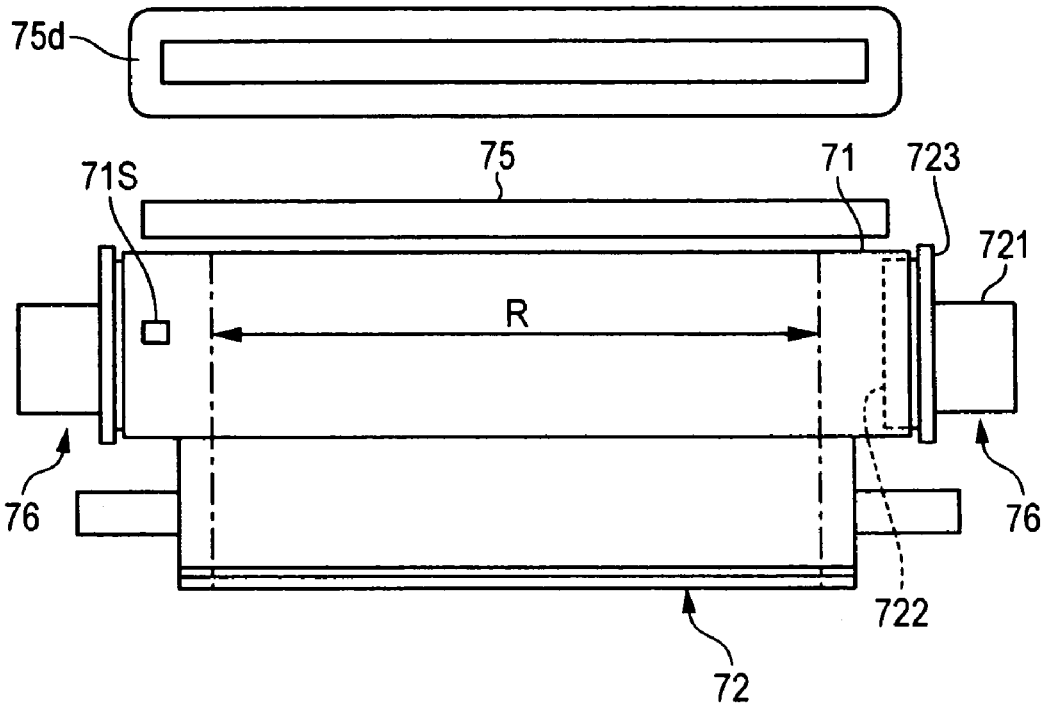
FIG. 3 is a schematic front view of the fixing device according to the exemplary embodiment of the invention.
Figure 4:
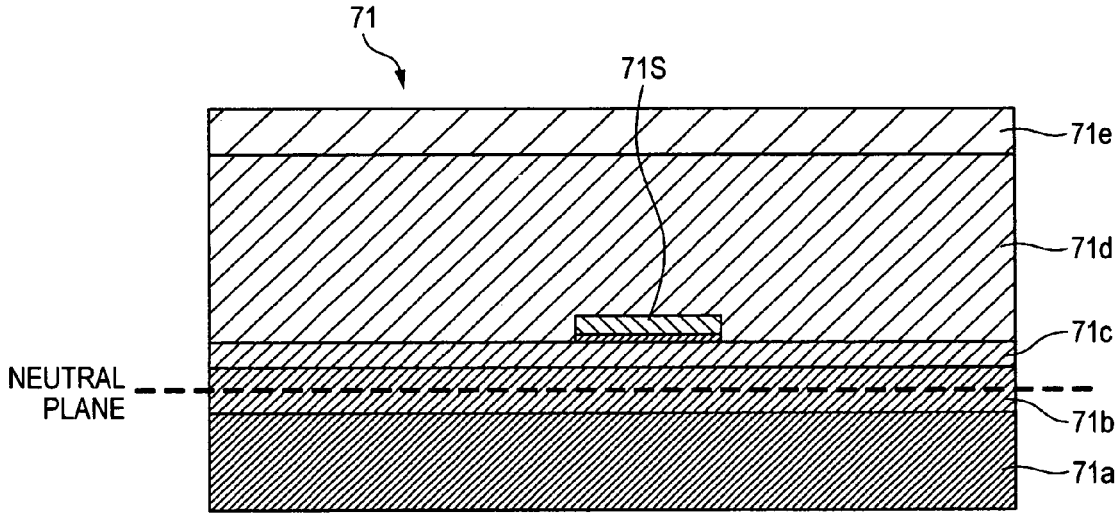
FIG. 4 is an enlarged front view to show the configuration of a fixing belt used in the fixing device according to the exemplary embodiment of the invention.

Next, the belt fixing device 7 according to this exemplary embodiment of the invention will be described in detail with reference to FIGS. 2 and 3. FIG. 2 is a schematic sectional view of the belt fixing device according to the exemplary embodiment. FIG. 3 is a schematic front view of the belt fixing device according to the exemplary embodiment. FIG. 4 is an enlarged front view to show the configuration of the fixing belt according to the exemplary embodiment.

As shown in FIGS. 2 and 3, the fixing device 7 according to the exemplary embodiment includes the fixing belt 71, the pressurization roll 72, a press pad 73 a pad support member 74, an electromagnetic induction heating device 75 and guide members 76. The fixing belt 71 has an endless peripheral surface. The pressurization roll 72 abuts against the outer peripheral surface of the fixing belt 71. The press pad 73 faces the pressurization roll 72 and abuts against the inner peripheral surface of the fixing belt 71 so as to press the fixing belt 71 against the pressurization roll 72. The pad support member 74 supports the press pad 73. The electromagnetic induction heating device 75 is provided along the outer peripheral surface of the fixing belt 71 and heats the fixing belt 71. The guide members 76*a* and 76*b* abut against the inner peripheral surfaces of both side edges of the fixing belt 71. Also, a temperature sensor 77 faces the outer peripheral surface of the fixing belt 71 and is disposed on the upstream side of the pressure-contact portion between the pressurization roll 72 and the press pad 73 in the rotation direction of the fixing belt 71. The temperature sensor 77 measures the surface temperature of the fixing belt 71.

As shown in FIG. 4, the fixing belt 71 includes a base layer 71*a*, a conductive layer 71*b*, a protection layer 71*c*, an elastic layer 71*d* and a surface release layer 71*e* in order from its inner peripheral surface to its top layer. The base layer 71*a* is formed of a sheet member having high heat resistance. The conductive layer 71*b* serves as a heat generation layer and disposed on the base layer. The protection layer 71*c* is disposed on the conductive layer 71*b*. The elastic layer 71*d* is disposed on the protection layer 71*c*. The surface release layer 71*e* forms the top layer. A primer layer may be provided between adjacent layers so as to bond the adjacent layers.

A flexible and heat-resistant material excellent in mechanical strength, such as a fluorocarbon resin, a polyimide resin, a polyamide resin, a polyamideimide resin, a PEEK resin, a PES resin, a PPS resin, a PFA resin, a PTFE resin or FEP resin may be used as the base layer 71*a*. The thickness of the base layer 71*a* is in a range of about 10 μm to about 100 μm, preferably, in a range of about 50 μm to about 100 μm (for example, 75 μm) from the viewpoint of providing compatibility between strength and flexibility and shortening the startup time. In this exemplary embodiment, a polyamide resin having 50 μm in thickness is used.

The conductive layer 71*b* is a heat generation layer, which generates heat by the electromagnetic induction action of a magnetic field produced by the electromagnetic induction heating device 75. The conductive layer 71*b* may be formed of a metal layer, such as iron, cobalt, nickel, copper, aluminum or chromium, having a thickness in a range of about 1 μm to about 30 μm. A material is selected so that the conductive layer 71*b* has a peculiar resistance value to generate sufficient heat by electromagnetic induction. In this exemplary embodiment, the conductive layer 71*b* is made of copper having 10 μm in thickness.

The protection layer 71*c* is a layer for making adjustment so that the heat generation layer (conductive layer) 71*b* is located in a neutral plane in the thickness direction of the fixing belt 71. The "neutral plane" is a plane in which bending strain does not occur even if the fixing belt 71 deforms. Any material may be used as the protection layer 71 so long as the protection layer has a predetermined Young's modulus and thickness. Considering the manufacturing cost and the heat capacity, it is desirable that the protection layer should be formed of a metal layer. In this exemplary embodiment, nickel having 5 μm in thickness is used as the protection layer 71*c*.

That is, in this exemplary embodiment, both of the conductive layer (heat generation layer) 71*b* and the protection layer 71*c* are formed of metal layers.

The elastic layer 71*d* may be made of silicone rubber, fluorocarbon rubber or fluoro silicone rubber, which has good heat resistance and good heat conductivity and has a thickness in a range of about 10 μm to about 500 μm, preferably in a range of about 50 μm to about 500 μm. In this exemplary embodiment, silicone rubber having 300 μm in thickness is used as the elastic layer 71*d*.

The surface release layer 71*e* is a layer for coming in direct contact with an unfixed toner image transferred onto a recording material P. Thus, the surface release layer 71*e* needs to be made of a material having good releasability. Examples of the material of the surface release layer 71*e* may include perfluoro-alkoxyfluoro plastics (PFA), polytetrafluoroethylene (PTFE), silicone resin, silicone rubber and fluorocarbon rubber. In this exemplary embodiment, PFA having 30 μm in thickness is used as the surface release layer 71*e*.

Further, the fixing belt 71 of this exemplary embodiment includes a detection piece 71S having a thin plate shape (thin film) serving as a deterioration detection unit. The detection piece 71S is disposed in a place where when the whole belt is bent, bending stain of the detection piece 71S is larger than that of the metal layer such as the heat generation layer 71*b* and/or the protection layer 71*c*. Specifically, the detection piece 71S is disposed outside the neutral plane of the fixing belt 71*c* in the thickness direction of the fixing belt 71*c* (that is, on the front-face side where the fixing belt 71*c* faces the pressurization roll 72) and outside the heat generation layer 71*b* and/or the protection layer 71*c*, which are the metal layers. The detection piece 71S has an area of about 5 mm square to about 30 mm square and has a thickness in a range of about 3 μm to about 30 μm. Furthermore, the detection piece 71S is disposed outside an area R through which a sheet of paper having a maximum size passes (in the axial direction). The detection piece 71S is used to detect deterioration of the heat generation layer 71*b* and/or deterioration of the protection layer 71*c* so as to determine the life of the fixing belt 71. Any material can be selected as the detection piece 71S appropriately so long as the selected material has correlation with deterioration of the metal layer (the heat generation layer 71*b* and/or the protection layer 71*c* ) caused by bending of the fixing belt 71. The metal material, which is the same as the heat generation layer 71*b* or the protection layer 71*c* , may be adopted as the detection piece 71S. The "same kind of metal" means that if the metal layer is formed of plural metal layers (for example, a copper heat generation layer and a nickel protection layer), the detection piece is made of the same metal as any of the plural metal layers.

In this exemplary embodiment, the detection piece 71S is disposed outside the neutral plane of the fixing belt 71 in the thickness direction thereof and outside the metal layers such as the heat generation layer 71*b* and/or the protection layer 71*c*. However, the detection piece 71S may be disposed in a place inside the fixing belt 71 in the thickness direction thereof so long as bending strain of the detection piece 71S is larger than that of the metal layer such as the heat generation layer 71*b* and/or the protection layer 71*c*.

Next, the pressurization roll 72 includes a metal cylindrical cored bar 72*a*, an elastic layer 72*b* and a surface release layer 72*c*. The metal cylindrical cored bar 72*a* serves as a core material. The elastic layer 72*b* has heat resistance, is made of silicone rubber or fluorocarbon rubber, and is disposed on the surface of the cored bar 72*a*. The surface release layer 72*c* formed the outermost surface of the pressurization roll 72. The pressurization roll 72 and the press pad 73 form a fixing nip portion while the pressurization roll 72 and the press pad 73 are clamping the fixing belt 71 therebetween.

The pressurization roll 72 is in pressure-contact with the press pad 73 through the fixing belt 71 with a load of 20 kgf. The pressurization roll 72 is driven circularly by a motor M. Also, the fixing belt 71 is driven to follow the rotation of the pressurization roll 72. When the recording material P to which an unfixed toner image is transferred is passed through the fixing nip portion between the fixing belt 71 and the pressurization roll 72, the unfixed toner image is fixed onto the recording material P by heat and pressure to form a fixed image.

The press pad 73 includes a pedestal 73*a* and an elastic member 73*b*. The pedestal 73*a* is made of a metal such as SUS or iron, or is made of a resin having a heat resistance. The elastic member 73*b* made of silicone rubber is bonded to the pedestal 73*a*. The press pad 73 presses the fixing belt 71 against the pressurization roll 72. The nip portion is formed between (i) the elastic member 73*b* and the fixing belt 71 and (ii) the pressurization roll 72. In this exemplary embodiment, to decrease mutual sliding frictional force between the press pad 73 and the fixing belt 71, a lubricant such as heat-resistant grease is applied to the nip portion between the press pad 73 and the fixing belt 71.

Each guide member 76 is made of a heat-resistant resin. Each guide member 76 includes a support part, an inner guide part 722 and an edge guide part 723. The support part 721 supports the pad support member 74 and is fixedly supported at its end in the axial direction. The inner guide part 722 regulates the side edge of the fixing belt 71. The edge guide part 723 is fitted into the corresponding end of the fixing belt 71 in the axial direction of the fixing belt 71.

The electromagnetic induction heating device 75 is placed along the outer peripheral surface of the fixing device 71 with a gap having about 2 mm from the outer peripheral surface of the fixing device. The electromagnetic induction heating device 75 heats the conductive layer of the fixing belt 71 by electromagnetic induction to generate heat. The electromagnetic induction heating device 75 has a main part including a pedestal, an excitation coil 75*b* and an excitation circuit 75*c*. The pedestal 75*a* has a curved surface along the outer peripheral surface of the fixing belt 71. The excitation coil 75*b* is supported on the pedestal 75*a*. The excitation circuit 75*c* supplies an AC current to the excitation coil 75*b*.

The pedestal 75*a* is made of a material having insulating properties and heat resistance. Examples of the material of the pedestal 75*a* may include a phenol resin, a polyimide resin, a polyamide resin, a polyamideimide resin and a liquid crystal polymer resin.

The excitation coil 75*b* is formed into a turn part 75*d* (shape of the excitation coil 75*b* viewed from the above), which is a litz wire wound plural times (e.g. 11 times) into a closed loop shape such as a rectangle shape, an oval shape or an ellipsoid shape and extending over the substantially entire region in the axial direction of the fixing belt 71. The litz wire is a bundle of several copper wires each having a diameter ϕ of 0.5 mm and insulated from each other by a heat-resistant insulating material (for example, polyimide resin, polyamideimide resin, etc.,). The excitation coil 75*b* is fixed with an adhesive to thereby be fixed to the pedestal 75*a* while the shape of the excitation coil 75*b* is maintained.

In the electromagnetic induction heating device 75, when an AC current is supplied from the excitation circuit 75*c* to the excitation coil 75*b*, a magnetic flux is generated and vanished repeatedly in the surroundings of the excitation coil 75*b*. The frequency of the AC current is in a range of about 10 kHz to about 50 kHz, for example. In this exemplary embodiment, the frequency of the AC current is set to 30 kHz. When the magnetic flux crosses the conductive layer 71*b* of the fixing belt 71, an eddy current occurs in the conductive layer 71*b* so as to produce a magnetic field to prevent change in the magnetic field and Joule heat occurs with power proportional to the skin resistance of the conductive layer 71*b* ($W=I^2R$) for heating the fixing belt 71 to a predetermined temperature.

Next, a method for detecting deterioration of the fixing belt 71 using the detection piece 71S according to this exemplary embodiment of the invention will be described.

Generally, if the thickness of the metal layer 71*b* of the heat generation layer is in a range of about 1 μm to about 30 μm as in this exemplary embodiment, as the thickness is larger, induction heating occurs more easily, that is, the power factor is larger. Therefore, when the detection piece 71S rotates with the rotation of the fixing belt 71 and crosses the excitation coil 75*b*, the power factor varies depending on whether or not the detection piece 71S exists just below the excitation coil 75*b*.

When the detection piece 71S exists just below the excitation coil 75*b*, the highest power factor is achieved.

Figure 5:
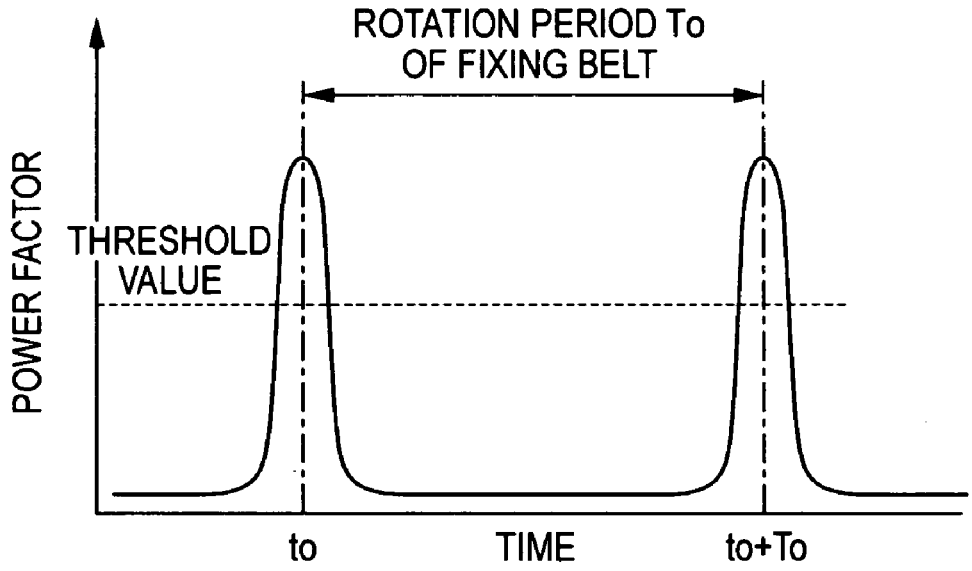
FIG. 5 is a view to show variation with time in power factor in accordance with a rotation position of a detection piece.

Then, this exemplary embodiment uses the excitation coil 75*b*, which serves as an electromagnetic induction heating unit, as a deterioration detection unit. The exemplary embodiment monitors change in the power factor of the detection piece 71S through the excitation coil 75*b*. Thereby, it is made possible to detect deterioration of the metal layer 71*b*, 71*c* of the fixing belt 71. FIG. 5 shows variation with time of the power factor responsive to the rotation position of the detection piece 71S, which serves as the deterioration detection unit.

Let the rotational period of the fixing belt 71 be $T_0$. As understood from FIG. 5, when the detection piece 71S comes just below the turn part 75*d* of the excitation coil 75*b* (in FIG. 5, when time T is equal to $t_0+nT_0$ where n is an integer), the power factor takes the maximum value.

Figure 6:
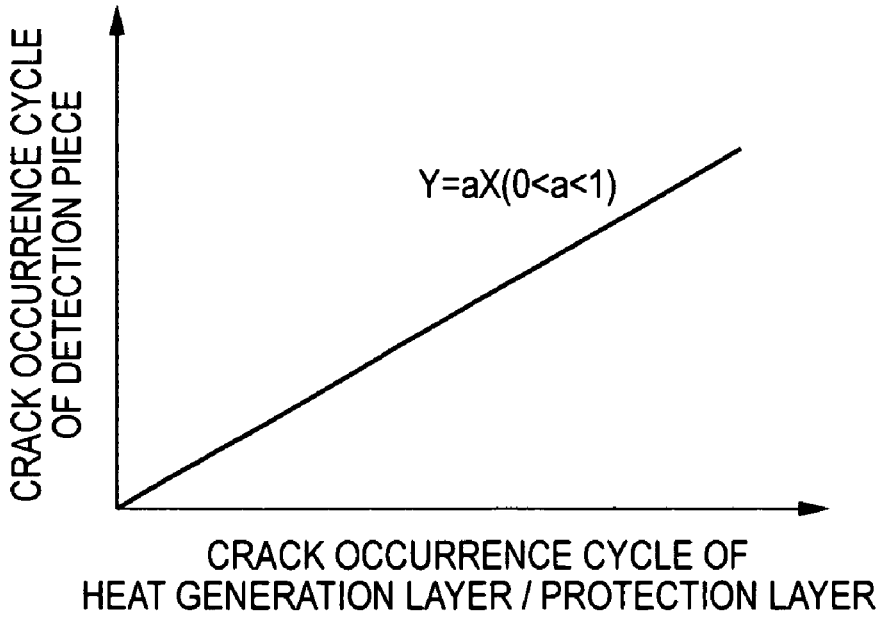
FIG. 6 is a view to show the linear relationship between (i) crack occurrence cycle of a heat generation layer and/or protection layer and (ii) crack occurrence cycle of the detection piece.

The detection piece 71S is disposed outside the heat generation layer 71*b* and/or the protection layer 71*c* and outside the neutral plane of the fixing belt 71 in the thickness direction thereof. Therefore, when the fixing belt 71 is deformed in the fixing nip portion, bending strain occurring in the detection piece 71S becomes larger than that occurring in the heat generation layer 71*b* and/or the protection layer 71*c*. As a result, if the fixing belt 71 becomes deformed repeatedly in the fixing nip, deterioration (crack) occurs on the detection piece 71S more early than the heat generation layer 71*b* and/or the protection layer 71*c*. That is, as schematically shown in FIG. 6, if the crack occurrence cycle (crack occurrence time) of the detection piece 71S is the vertical axis and the crack occurrence cycle (crack occurrence time) of the heat generation layer 71*b* and/or the protection layer 71*c* is the horizontal axis, it can be seen that both have a linear correlation and the crack occurrence of the detection piece 71S is earlier than the crack occurrence of the heat generation layer 71*b*/the protection layer 71*c*.

Figure 7:
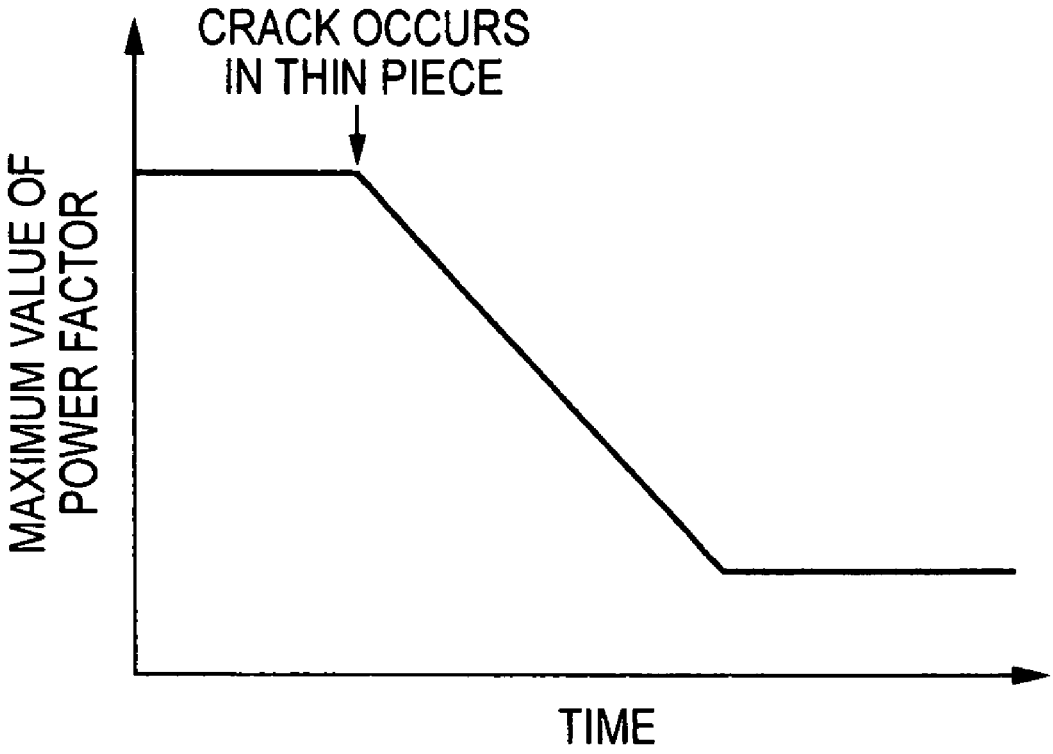
FIG. 7 is a view to schematically show change in the maximum value of the power factor accompanying occurrence of a crack.

When a crack occurs in the detection piece 71S, the maximum value of the power factor detected through the excitation coil 75*b* becomes small as compared with the case where no crack occurs in the detection piece 71S. That is, as schematically shown in FIG. 7, if the maximum value of the power factor is plotted with respect to the time, it shows a given value to a certain point in time. When a crack starts to occur in the detection piece 71S, the power factor lowers almost linearly and becomes stable at another value. The time at which a crack occurs in the detection piece 71S and the time at which a crack occurs in the heat generation layer 71*b* and/or the protection layer 71*c* have a linear correlation as described above. Therefore, when the time at which a crack occurs in the detection piece 71S is detected, it is made possible to predict the life of the heat generation layer 71*b* and/or the protection layer 71*c*, which determines the life of the fixing belt 71.

That is, according to the deterioration detection unit according to this exemplary embodiment, change in the power factor of the detection piece 71S is monitored through the excitation coil 75*b*. Thereby, it is made possible to detect the precise life responsive to the use state of the fixing belt 71, based on the predetermined correlation between (i) the life of the heat generation layer 71*b* and/or the protection layer 71*c* of the fixing belt 71 and (ii) the life of the detection piece 71S.

Next, a specific examination result using such a deterioration detection unit will be described.

To conduct an examination, first the nickel detection piece 71S having 3 μm in thickness is disposed via a thin primer layer on the nickel protection layer 71*c* (having 5 μm in thickness) of the fixing belt 71 and outside the area R through which the sheet of paper having the maximum size passes in the axial direction. The position of the neutral plane is the center of the copper heat generation layer 71*b* having 10 μm in thickness by adjusting the Young's modulus of each layer. The distance between the neutral plane and the nickel surface of the protection layer 71*c* is 10 μm. The distance between the neutral plane and the surface of the detection piece 71S is 13 μm.

Therefore, when the fixing belt 71 is deformed, a ratio of bending strain occurring in the surface of the protection layer 71*c* to bending strain occurring on the surface of the detection piece 71S becomes 1:1.3 in theory.

Although the bending strain and the crack occurrence cycle do not have a linear relation with each other in a wide range, it may be said that 30% in difference is almost a linear relationship in terms of the strain level in the fixing nip portion. Therefore, letting the number of cycles until a crack starts occurring in the detection piece 71S in the long-hour fixing operation, namely, the number of cycles until the maximum value of the power factor starts decreasing be Ch, it can be predicted that a crack will occur on the protection layer 71*c*, namely, the end of the life will be reached in 0.3×Ch cycles from the time when the crack occurs in the detection piece 75S.

Therefore, a message indicating that the fixing belt 71 is just before it will reach the end of the life may be displayed at an appropriate point in time after the number of crack occurrence cycles Ch.

Actually, occurrence of a crack in the protection layer 71*c* of the fixing belt 71 in the vicinity of 1.3×Ch cycles under a predetermined fixing condition can be verified. Accordingly, it can be verified that the deterioration detection unit according to this exemplary embodiment of the invention can detect the precise life of the fixing belt 71 responsive to the use state of the fixing belt 71.

In the exemplary embodiment described above, the deterioration detection unit detects the life of the fixing belt 71 by detecting change in the power factor of the detection piece 71S. However, the invention is not limited to such a deterioration detection unit. A deterioration detection unit according to another exemplary embodiment may monitor change in the magnetic characteristic value of the detection piece 71S having a correlation with the life of the metal layer 71*b*, 71*c* of the fixing belt 71 through the excitation coil 75*b*. For example, change in the inductance of the detection piece 71S may be monitored through the excitation coil 75*b*, to thereby detect deterioration of the fixing belt 71.

Further, in the above described exemplary embodiment, the detection piece 71S made of the same kind of metal as the metal layer 71*b*, 71*c* is disposed in the fixing belt 71 so as to detect deterioration of the metal layer 71*b*, 71*c* from the viewpoint of stably detecting deterioration of the metal layer with higher accuracy. However, from the viewpoint of detecting deterioration of the metal layer 71*b*, 71*c* with a simpler configuration using a device configuration of a related art, the detection piece 71S may be omitted and the voltage/current of the excitation coil 75*b* may be monitored. According to this configuration, deterioration of the metal layer 71*b*, 71*c* of the fixing belt 71 can also be determined. That is, in so doing, when an actual crack occurs in the metal layer 71*b*, 71*c*, for example, the inductance of the crack occurrence part changes and the voltage/current induced to the excitation coil 75*b* changes. Thus, although it is inferior to use of the detection piece 71S in detection of deterioration of the metal layer 71*b*, 71*c* at rapid and stable timing with accuracy, it is made possible to determine deterioration of the fixing belt 71 according to the same device configuration as that in the related art by monitoring the voltage/current inducted to the excitation coil 75*b*. This configuration contributes to drastic cost reduction and device miniaturization as compared with a configuration provided with a special sensor.

What is claimed is:

1. A belt fixing device comprising:

an endless belt member that includes a metal layer;

an excitation coil that heats the metal layer by electromagnetic induction;

a detection piece disposed in an area of the belt member where a bending strain of the detection piece is larger than that of the metal layer; and a deterioration detection unit configured to detect, through the excitation coil, change in a characteristic value of the detection piece, which has a correlation with deterioration of the metal layer.

2. The belt fixing device according to claim 1, wherein the detection piece is made of the same kind of metal as the metal layer.

3. The belt fixing device according to claim 2, wherein the detection piece is disposed outside an area through which a sheet of paper having a maximum size passes.

4. The belt fixing device according to claim 2, wherein the detection piece has 5 mm square to 30 mm square in area and has 3 μm to 30 μm in thickness.

5. The belt fixing device according to claim 1, wherein the detection piece is disposed outside an area through which a sheet of paper having a maximum size passes.

6. The belt fixing device according to claim 1, wherein the detection piece has 5 mm square to 30 mm square in area and has 3 μm to 30 μm in thickness.

7. An image forming apparatus comprising a belt fixing device according to claim 1.

* * * * *